US012349857B2

(12) United States Patent
Hughett et al.

(10) Patent No.: US 12,349,857 B2
(45) Date of Patent: Jul. 8, 2025

(54) DUSTPAN ACCESSORY TOOL FOR VACUUM CLEANER

(71) Applicant: TECHTRONIC CORDLESS GP, Anderson, SC (US)

(72) Inventors: Stephen A. Hughett, Anderson, SC (US); Tyler H. Knight, Greenville, SC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 17/678,757

(22) Filed: Feb. 23, 2022

(65) Prior Publication Data

US 2022/0265103 A1 Aug. 25, 2022

Related U.S. Application Data

(60) Provisional application No. 63/153,787, filed on Feb. 25, 2021.

(51) Int. Cl.
*A47L 9/06* (2006.01)
*A47L 5/36* (2006.01)
(Continued)

(52) U.S. Cl.
CPC ..... *A47L 9/0693* (2013.01); *A47L 5/362* (2013.01); *A47L 9/0673* (2013.01); *A47L 9/10* (2013.01); *A47L 9/327* (2013.01); *A47L 13/52* (2013.01)

(58) Field of Classification Search
CPC ..... A47L 13/38; A47L 13/52; A47L 13/362; A47L 13/327; A47L 7/0004;
(Continued)

(56) References Cited

U.S. PATENT DOCUMENTS 2,242,278 A 5/1941 Yonkers, Jr.
5,839,157 A 11/1998 Strauser et al.
(Continued)

FOREIGN PATENT DOCUMENTS

CA 2301424 A1 * 9/2001 ..... A47L 13/52
CN 2726515 Y 9/2005
(Continued)

OTHER PUBLICATIONS

WIPO Translation CA 2301424; Removable Displaceable Dustpan; O'Brien, Michael; Sep. 16, 2001 (Year: 2001).*
(Continued)

*Primary Examiner* — Brian D Keller
*Assistant Examiner* — Sidney D Full
(74) *Attorney, Agent, or Firm* — Michael Best & Friedrich LLP

(57) ABSTRACT

A vacuum cleaner, movable over a surface, includes a suction source, a suction port, and a dustpan attachment removably coupled to the suction port. The dustpan attachment includes a housing, a vacuum port, and a recess defined within the housing. The housing includes a top wall and a plurality of walls extending from the top wall to a bottom edge configured to contact the surface. The vacuum port extends through at least the top wall or one of the plurality of walls and is coupled to the suction port. When the bottom edge contacts the surface, the recess cooperates with the surface to form a suction channel having a suction inlet formed in a front of the housing and in communication with the vacuum port. The housing defines first and second ends. The bottom edge includes a sealing material that contacts the surface continuously between the first and second ends.

20 Claims, 9 Drawing Sheets

(51) Int. Cl.
*A47L 9/10* (2006.01)
*A47L 9/32* (2006.01)
*A47L 13/52* (2006.01)

(58) Field of Classification Search
CPC .. A47L 7/0009; A47L 7/00014; A47L 7/0066; A47L 7/0071; A47L 9/02; A47L 9/0693; A47L 9/0673; A47L 9/10; A47L 11/4044; A47L 11/4036; A47L 9/102; A47L 5/362; A47L 13/502
USPC ..... 15/415.1, 301
See application file for complete search history.

(56) References Cited

U.S. PATENT DOCUMENTS

| | | | | |
|---|---|---|---|---|
| 6,584,640 | B2 * | 7/2003 | Vanderlinden | A47L 9/02 15/418 |
| 6,601,266 | B1 * | 8/2003 | Faraci | A47L 11/4075 15/246.2 |
| 7,412,749 | B2 | 8/2008 | Thomas et al. | |
| 7,877,839 | B2 * | 2/2011 | Phelan | A47L 7/0009 15/354 |
| 8,556,135 | B2 * | 10/2013 | Edmondson | B65D 88/548 222/377 |
| 8,938,849 | B2 * | 1/2015 | Cleary | A47L 9/2842 15/301 |
| 11,071,425 | B2 | 7/2021 | Westbrook | |
| 2006/0026790 | A1 | 2/2006 | Consilvio | |
| 2008/0271283 | A1 | 11/2008 | Thomas et al. | |
| 2011/0296644 | A1 | 12/2011 | Grassman | |
| 2012/0210539 | A1 * | 8/2012 | Diminick | A47L 7/0009 15/415.1 |
| 2015/0265115 | A1 * | 9/2015 | Gray | A47L 9/242 15/415.1 |
| 2017/0319043 | A1 | 11/2017 | Kerntopf et al. | |
| 2020/0187737 | A1 | 6/2020 | Croggon et al. | |
| 2021/0347090 | A1 * | 11/2021 | Holzmeier | B23B 47/34 |

FOREIGN PATENT DOCUMENTS

| | | | |
|---|---|---|---|
| CN | 101524256 | A | 9/2009 |
| CN | 204306782 | U | 5/2015 |
| CN | 204909336 | U | 12/2015 |
| CN | 204919454 | U | 12/2015 |
| CN | 206687671 | U | 12/2017 |
| CN | 211484434 | U | 9/2020 |
| EP | 3666148 | A1 | 6/2020 |
| EP | 3073881 | B1 | 7/2020 |
| ES | 1230529 | U | 6/2019 |
| JP | 3178558 | U | 9/2012 |
| WO | 2009106612 | A1 | 9/2009 |
| WO | 2017197483 | A1 | 11/2017 |

OTHER PUBLICATIONS

Extended European Search Report for Application No. 22158657.1 dated Jan. 23, 2023 (9 pages).
European Patent Office Action for Application No. 22158657.1 dated Feb. 21, 2025 (4 pages).

* cited by examiner

DUSTPAN ACCESSORY TOOL FOR VACUUM CLEANER

CROSS-REFERENCE TO RELATED APPLICATIONS

This application claims priority to U.S. Provisional Patent Application No. 63/153,787, filed on Feb. 25, 2021, the entire contents of which are incorporated herein by reference.

FIELD OF THE INVENTION

The present invention relates to accessory tools for vacuum cleaners, and more particularly to a dustpan vacuum cleaner accessory tool.

BACKGROUND OF THE INVENTION

Vacuums typically include impeller units which generate suction fluid flow into a separator which separates suction debris from an airflow. Vacuums include dirty fluid inlets in fluid communication with the impeller unit to direct dirty fluid from work surfaces and into the separator. Occasionally, dirty fluid inlets are provided by hoses coupled to the separator. Suction nozzle attachments or other accessory tools are removably attached to the separator via the hose to extend the reach of the suction.

SUMMARY OF THE INVENTION

The disclosure provides, in one aspect, a vacuum accessory tool operable to be movable over a surface to be cleaned. The vacuum cleaner includes a suction source, a suction port in fluid communication with the suction source, and a dustpan attachment removably coupled to the suction port. The dustpan attachment includes a housing, a vacuum port, and a recess. The housing includes a top wall and a plurality of walls extending from the top wall to a bottom edge. The bottom edge is configured to contact the surface. The vacuum port extends through at least the top wall or one of the plurality of walls and is coupled to the suction port. The recess is defined within the housing. When the bottom edge contacts the surface, the recess is configured to cooperate with the surface to form a suction channel having a suction inlet in communication with the vacuum port. The suction inlet is formed in a front of the housing and opens forwardly. The housing defines a first end at one end of the suction inlet and second end at an opposite end of the suction inlet. The bottom edge includes a resilient sealing material that contacts the surface continuously between the first and second ends.

The disclosure provides, in another independent aspect, a dustpan attachment for use with a vacuum cleaner configured to clean a surface. The vacuum cleaner has a suction port and a suction source for generating airflow through the suction port. The dustpan attachment includes a housing, a vacuum port, and a recess. The housing includes a top wall and a plurality of walls extending from the top wall to a bottom edge. The bottom edge is configured to contact the surface. The vacuum port extends through at least the top wall or one of the plurality of walls and is configured to removably couple to the suction port of the vacuum cleaner. The recess is defined within the housing. When the bottom edge contacts the surface, the recess is configured to cooperate with the surface to form a suction channel having a suction inlet in communication with the vacuum port. The suction inlet is formed in a front of the housing and opens forwardly. The housing defines a first end at one end of the suction inlet and second end at an opposite end of the suction inlet. The bottom edge includes a resilient sealing material that contacts the surface continuously between the first and second ends.

The disclosure provides, in another independent aspect, a dustpan attachment for use with a vacuum cleaner configured to clean a surface. The vacuum cleaner has a suction port and a suction source for generating airflow through the suction port. The dustpan attachment includes a housing, a vacuum port, and a recess. The housing includes a top wall, a pair of sidewalls, and a rear wall extending from the top wall to a bottom edge. The bottom edge is configured to contact the surface. The vacuum port extends through the top wall and is configured to removably couple to the suction port. The recess is defined by the top wall, the pair of sidewalls, and the rear wall. When the bottom edge contacts the surface, the recess is configured to cooperate with the surface to form a suction channel in communication with the vacuum port. A suction inlet is defined at a front of the housing and opening forwardly. The suction inlet is in fluid communication with the vacuum port such that debris in an area in front of the suction inlet is drawn through the suction channel into the suction port. The housing defines a first end at one end of the suction inlet and a second end at an opposite end of the suction inlet. The bottom edge includes a resilient sealing material that contacts the surface continuously between the first and second ends. The suction inlet extends along the front of the housing to a width between 6 and 20 inches.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
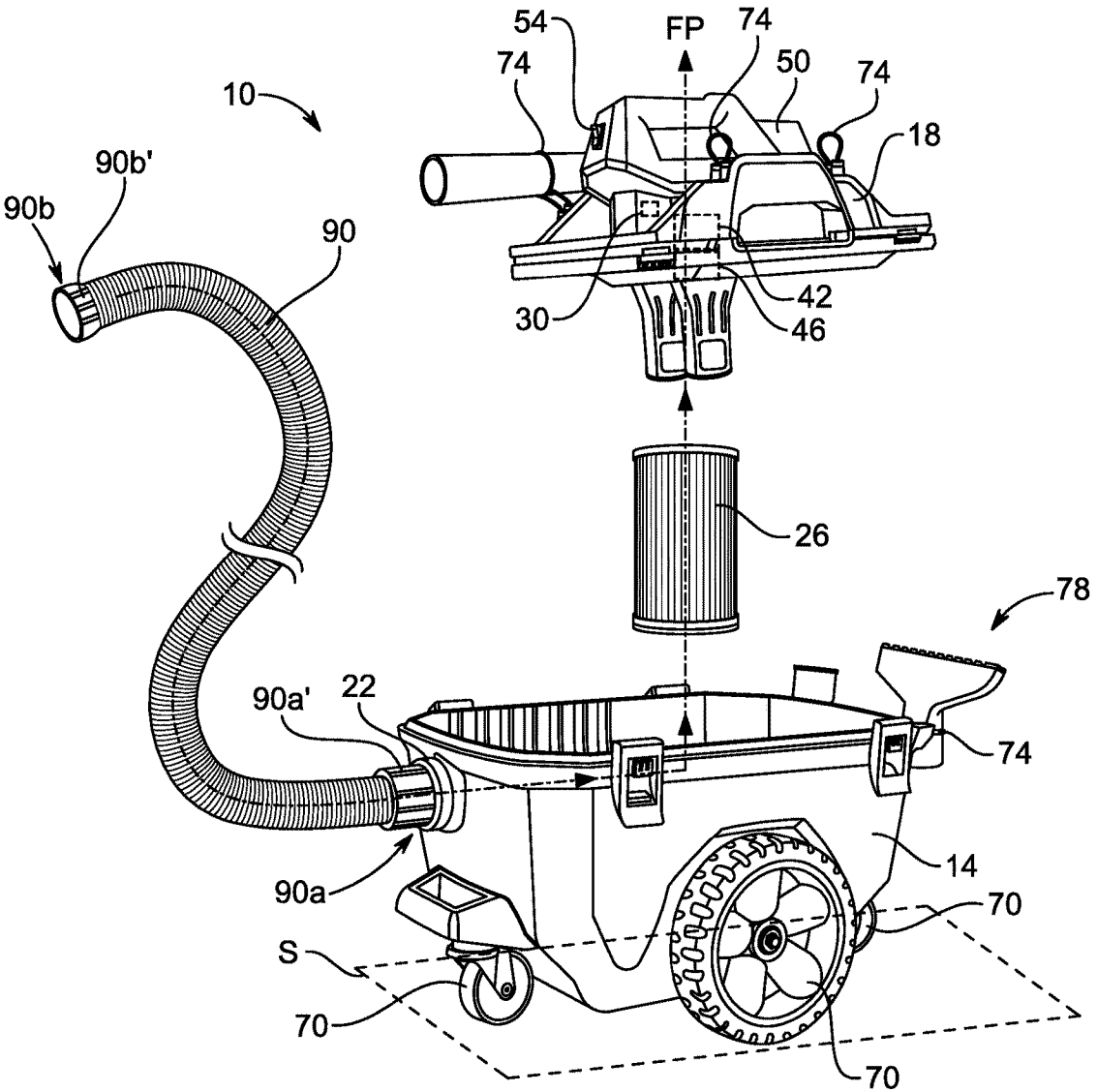
FIG. 1 illustrates an exemplary vacuum cleaner.

FIG. 1 illustrates a vacuum cleaner 10 configured to be coupled to an accessory tool. With continued reference to FIG. 1, the vacuum cleaner 10 includes a base 14 and a lid 18 selectively removable from the base 14. The vacuum cleaner 10 includes a vacuum cleaner inlet 22, a separator 26, and a clean air outlet 30. The vacuum cleaner inlet 22 is provided on the base 14. The separator 26 is removably (i.e., selectively) coupled to the lid 18 of the vacuum cleaner 10. The separator 26 is in fluid communication with the vacuum cleaner inlet 22 and is configured to separate debris (e.g., solid debris and/or liquid working fluid) from clean air. The clean air outlet 30 is in fluid communication with the separator 26 opposite the vacuum cleaner inlet 22 such that the clean air that passes through the separator 26 is exhausted through the clean air outlet 30 to the surroundings of the vacuum cleaner 10. In the illustrated embodiment, the illustrated vacuum cleaner 10 is a canister style wet/dry vacuum cleaner operable to vacuum solid debris and/or liquid working fluid. Optionally, a seal is provided between the base 14 and the lid 18. Other arrangements of the vacuum cleaner 10 are possible, such as an upright extractor, a stick or pole vacuum, or a handheld vacuum.

The vacuum cleaner 10 includes a motor 42 and an impeller 46 coupled to the motor 42. The motor 42 and the impeller 46 are configured to generate suction to move fluid through the fluid flow path FP. The fluid flow path FP extends through the vacuum cleaner inlet 22, the separator 26, and out the clean air outlet 30 to the surroundings of the vacuum cleaner 10. In the illustrated embodiment, the illustrated motor 42 and impeller 46 are coupled to the lid 18. Other locations of the motor 42 and impeller 46 are possible.

The motor 42 is powered by a power source 50. The power source 50 may be a battery pack which is selectively coupled to the vacuum cleaner 10. More specifically, the power source 50 may be selectively coupled to the lid 18. The illustrated vacuum cleaner 10 further includes a user control 54 coupled to the power source 50 and the motor 42 to selectively transmit power from the power source 50 to the motor 42. When activated by the user control 54, the power source 50 is configured to power the motor 42 and the impeller 46 to move fluid along the fluid flow path FP. In the illustrated embodiment, the user control 54 is provided on the lid 18. Other arrangements or locations of the power source 50 and the user control 54 are possible. For example, some embodiments may include a power cord for connecting the vacuum cleaner 10 to a main power grid for receiving alternating current.

The base 14 includes at least one wheel 70. A user operating the vacuum cleaner 10 may grasp a portion of the vacuum cleaner 10 to translate the vacuum cleaner 10 along a surface S towards a portion of the surface S that needs to be cleaned. The illustrated embodiment includes a plurality of wheels 70. The wheels 70 are rotatably secured to the base 14 such that the wheels 70 are configured to slide the vacuum cleaner 10 along the surface S. Some of the wheels 70 may be caster wheels. Otherwise, the user may lift the vacuum cleaner 10 from the surface S to move the vacuum cleaner 10 to the portion of the surface S that needs to be cleaned.

The vacuum cleaner 10 includes at least one accessory connector 74. The accessory connector 74 is configured to mechanically secure an accessory 78 of the vacuum cleaner 10 to the vacuum cleaner 10. The accessory 78 may be a suction nozzle, an extension tube, a flexible hose 90, an accessory tool, or the like. The accessory connector 74 may secure the accessory 78 to the vacuum cleaner 10 during use or for storage of the accessory 78 on the vacuum cleaner 10 while the accessory 78 is not in use with the vacuum cleaner 10. The illustrated embodiment includes a plurality of accessory connectors 74. The accessory connectors 74 may be provided on either or both of the base 14 and the lid 18.

The illustrated base 14 functions as a debris collector to receive solid debris and/or liquid working fluid which is separated by the separator 26.

With continued reference to FIG. 1, the flexible hose 90 includes a first end 90*a* with a connector 90*a*'. The flexible hose 90 further includes an opposite second end 90*b* with a connector 90*b*'. The connector 90*a*' may be secured to the vacuum cleaner inlet 22. This effectively moves the inlet of the vacuum cleaner 10 to the second end 90*b* of the flexible hose 90. The second end 90*b* of the flexible hose 90 acts as a suction port for the vacuum cleaner 10. The connector 90*b*' may be secured to an accessory tool. The connectors 90*a*', 90*b*' are removably secured to the vacuum cleaner inlet 22 and the accessory tool respectively. This permits assembly and disassembly of the vacuum cleaner 10 for storage or transport.

FIGS. 2-6 illustrate one embodiment of an accessory tool 200. The accessory tool 200 is formed as a dustpan attachment 200 for use with a vacuum cleaner, such as the vacuum cleaner 10 shown in FIG. 1. The accessory tool 200 may be used with other types of vacuum cleaners, such as upright cleaners, wet/dry vacuums, extractors, and more.

Figure 2:
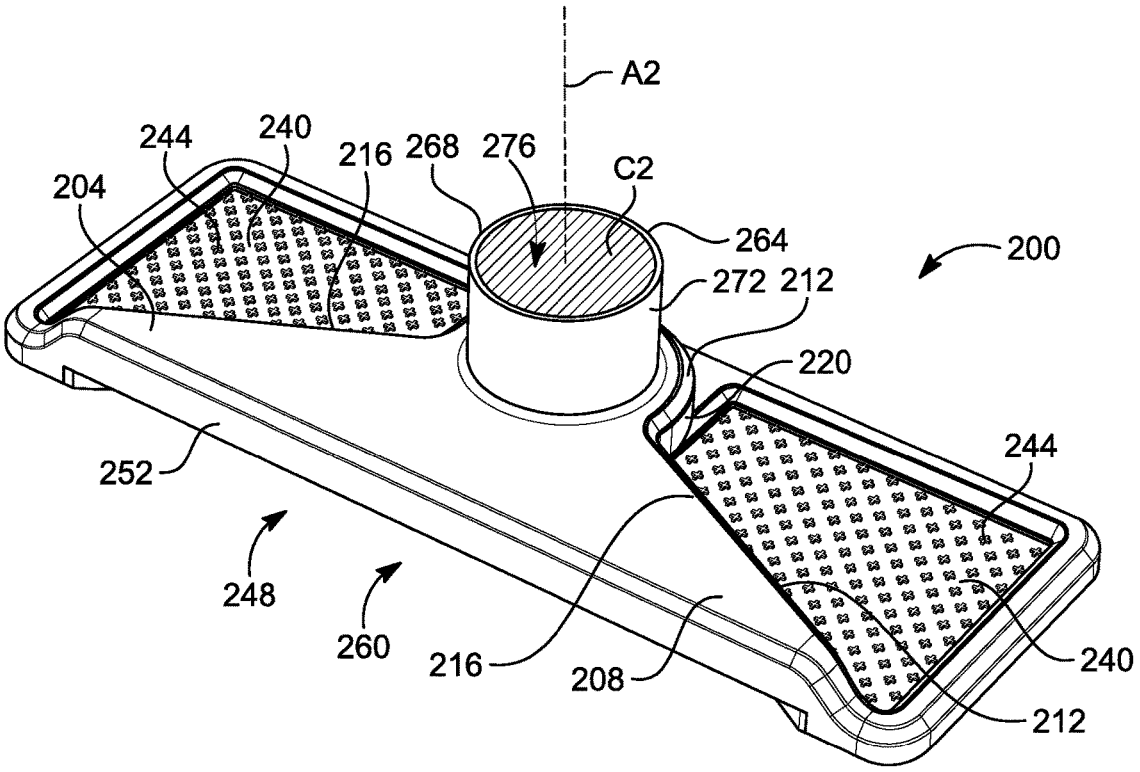
FIG. 2 is an upper perspective view of an accessory tool for use with a vacuum cleaner, for example the vacuum cleaner shown in FIG. 1.
Figure 3:
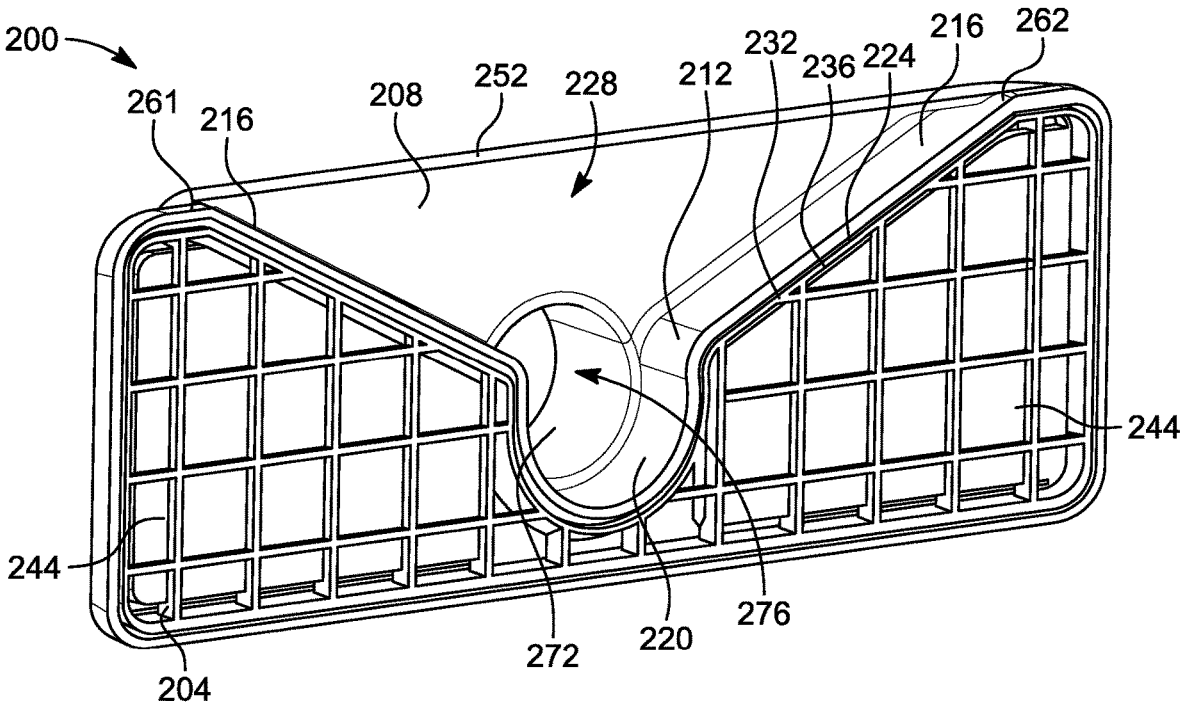
FIG. 3 is a lower perspective view of the accessory tool of FIG. 2.

As shown in FIGS. 2-3, the dustpan attachment 200 includes a housing 204. The housing 204 includes a top wall 208 and a plurality of walls 212 extending from the top wall 208. The plurality of walls 212 includes a pair of side walls 216 and a rear wall 220 which extend from the top wall 208 to a bottom edge 224. As shown in FIG. 3, the plurality of walls 212 and the top wall 208 form a recess 228 in the housing 204, surrounded by the bottom edge 224. The bottom edge 224 may be positioned against the surface S. The bottom edge 224 includes a groove 232 to receive a sealing element 236 or sealing member 236. The sealing element 236 may include a resilient sealing material. For example, the sealing element 236 may be formed as a rubber gasket. In some embodiments, other sealing materials may be used. The sealing element 236 cooperates with the surface S when the bottom edge 224 is placed against the surface S to prevent fluid flow under the bottom edge 224.

The housing 204 includes one or more receiving surfaces 240 which may receive a foot or another portion of an operator's body to prevent translation of the housing 204 relative to the surface S and to increase the sealing between the sealing element 236 and the surface S. In the illustrated embodiment the receiving surfaces 240 are formed as a pair of flanges 244 extending rearwardly from the bottom edge 224. The flanges 244 are textured to increase the grip between the operator and the receiving surface 240. The pair of flanges 244 are positioned with one on either side of the housing 204. The pair of flanges 244 are positioned to contact the surface S when the bottom edge 224 is positioned against the surface S.

Figure 4:
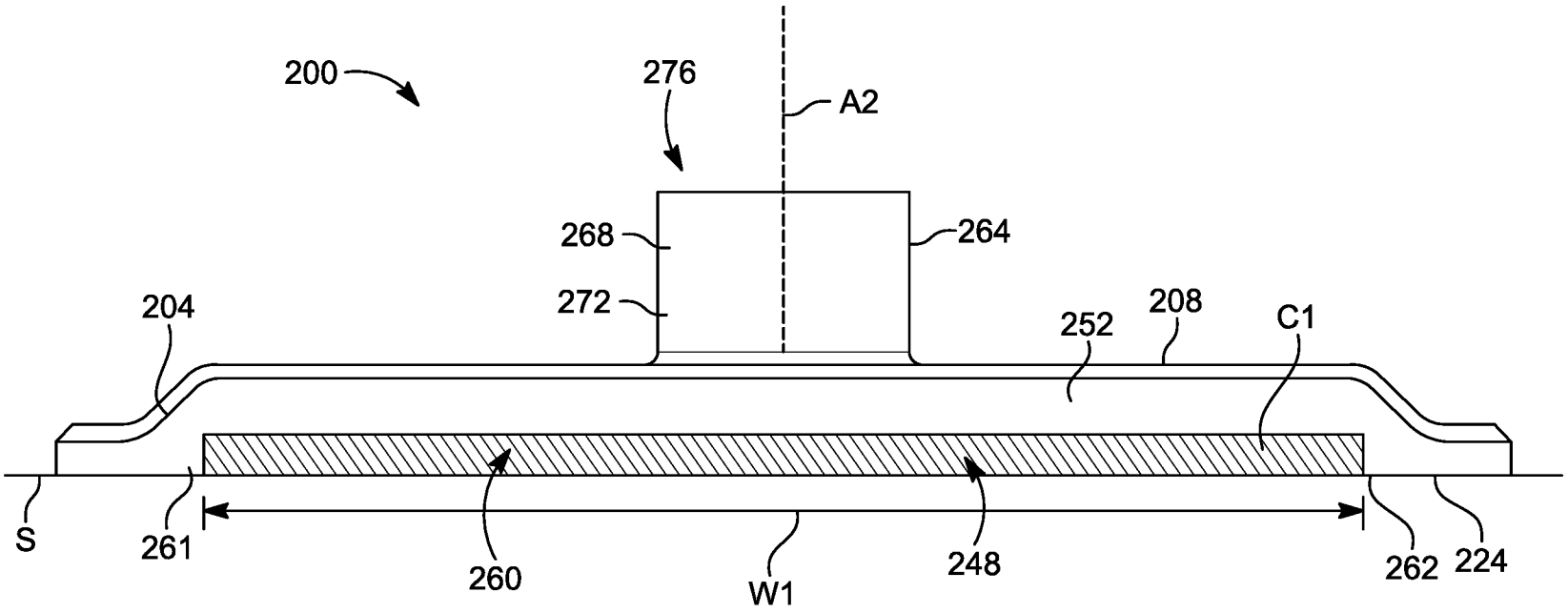
FIG. 4 is a front view of the accessory tool of FIG. 2.
Figure 6:
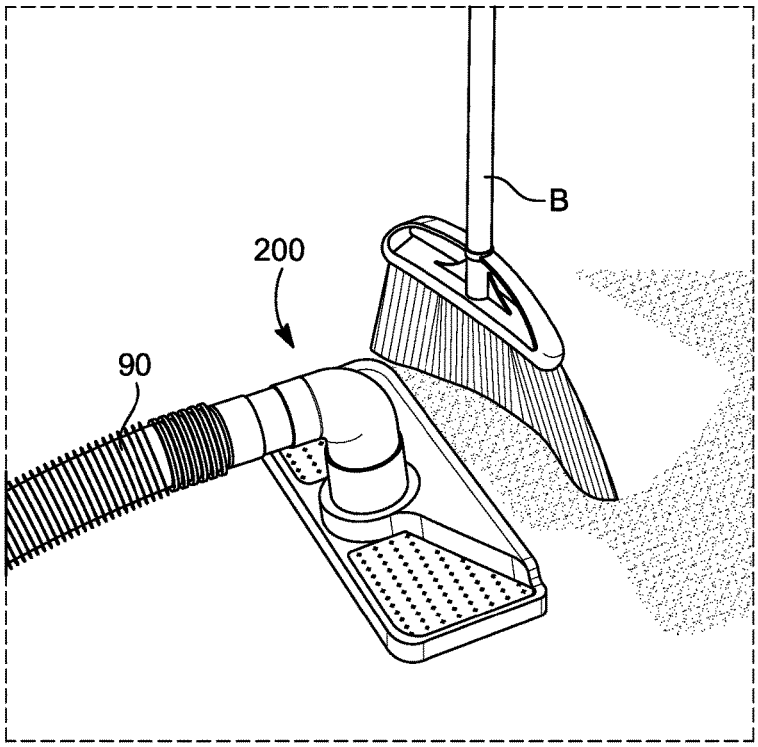
FIG. 6 illustrates the accessory tool of FIG. 2 in use with a vacuum cleaner.

With reference to FIGS. 2 and 4, the housing 204 also includes a front opening 248. In the illustrated embodiment, a front lip 252 extends from a front edge 256 of the top wall 208. The front opening 248 is positioned beneath the front lip 252 and forms a suction inlet 260 when the bottom edge 224 is positioned against the surface S. The front opening 248 opens forwardly and extends along almost the entire width of the housing 204. In some embodiments, the front opening 248 has a width W of between 6 and 20 inches. More specifically, the width W may correspond to a width of a head of a standard sweeping implement such as a broom B (FIG. 6). The suction inlet 260 extends between a first end 261 of the housing 204, adjacent one end of the suction inlet 260, and a second end 262 of the housing 204, adjacent the opposite end of the suction inlet 260. The bottom edge 224 also extends between the first end 261 and the second end 262 around the recess 228. The bottom edge 224 includes resilient sealing material continuously between the first end 261 of the housing 204 and the second end 262 of the housing 204. The suction inlet 260 extends into the housing 204 along a first axis A1. When the bottom edge 224 is positioned against the surface S, the first axis A1 is generally horizontal. The suction inlet 260 has a cross sectional area C1 (or first area C1) measured perpendicular to the first axis A1. The suction inlet 260 is generally rectangular in shape.

As shown best in FIG. 2, the dustpan attachment 200 further includes a vacuum port 264. In the illustrated embodiment, the vacuum port 264 is coupled to the top wall 208 of the housing 204. In other embodiments, the vacuum port 264 may extend from any of the plurality of walls 212, or may extend through or span multiple walls, including the top wall 208 or the plurality of walls 212. For example, in some embodiments, the vacuum port 264 may extend from the rear wall 220. In the illustrated embodiment, the vacuum port 264 includes a connector 268 extending from the top wall 208. The connector 268 includes an outer wall 272 defining a channel 276 which extends along a second axis A2 through the housing 204 and connects to the recess 228. When the bottom edge 224 is positioned against the surface S, the second axis extends generally vertically. The vacuum port 264 has a generally circular shape and a cross sectional area C2 (or second area C2) measured perpendicular to the second axis A2. The cross sectional area C2 of the vacuum port 264 is generally equal in size to the cross sectional area C1 of the suction inlet 260.

Figure 5:
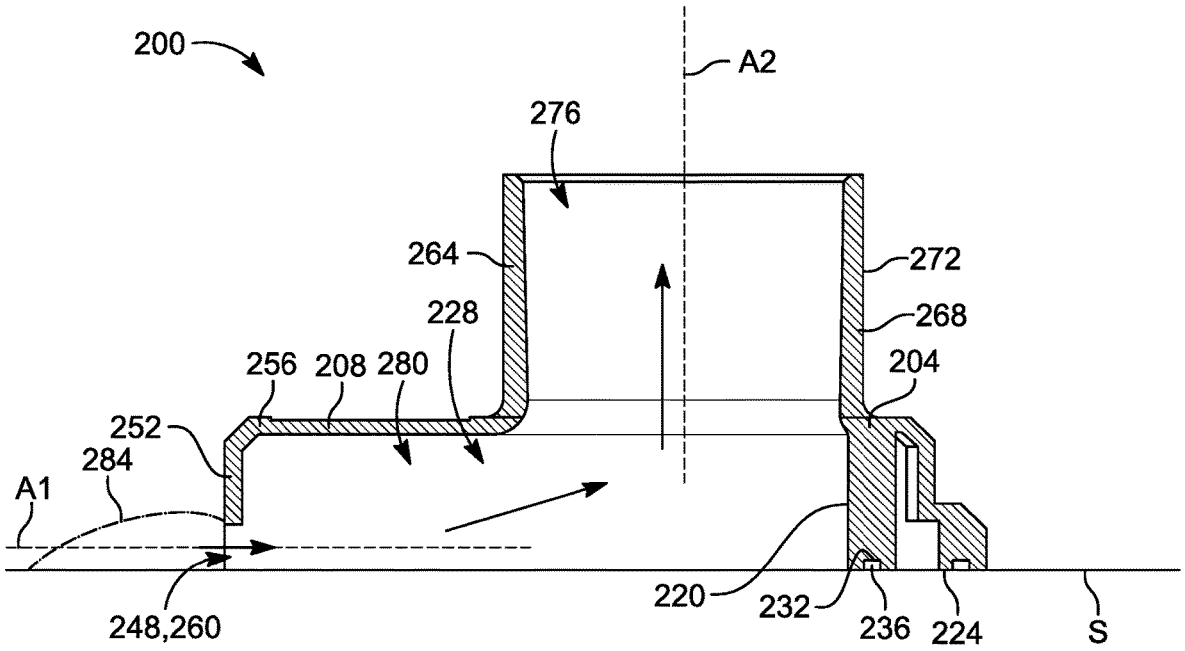
FIG. 5 is a cross sectional view of the accessory tool of FIG. 2.

As shown in FIGS. 4 and 5, when the bottom edge 224 is positioned against the surface S, the recess 228 cooperates with the surface S to create a suction channel 280. The sealing element 236 helps to seal the suction channel 280 around the bottom edge 224. The suction channel 280 extends between the suction inlet 260 and the vacuum port 264. The suction channel 280 converges in the width direction, such that the air is funneled toward the vacuum port 264. The vacuum port 264 may be removably coupled to the hose connector 90*b*'. This effectively moves the inlet of the vacuum cleaner 10 to the suction inlet 260 of the dustpan attachment 200. As such, the vacuum cleaner inlet 22 is in fluid communication with the suction inlet 260. When the flexible hose 90 is secured to the vacuum cleaner inlet 22 and the dustpan attachment 200, the fluid flow path FP extends from the suction inlet 260 of the dustpan attachment 200, through the flexible hose 90, and into the vacuum cleaner inlet 22. While connected to the vacuum cleaner inlet 22 via the flexible hose 90, the accessory tool 200 is movable along the surface S into proximity to the portion of the surface S that needs to be cleaned. This affords a range of motion for the accessory tool 200 to move relative to the base 14 and the lid 18.

As shown in FIGS. 5 and 6, while connected to the vacuum cleaner 10 and positioned with the bottom edge 224 on the surface S, a suction zone 284 (also referred to as a suction area 284) may be created adjacent to the suction inlet 260. In use, the vacuum cleaner 10 can be powered on using the user control 54, so that the motor 42 and impeller 46 create a suction flow in the fluid flow path FP, including in the suction zone 284. An operator can secure the dustpan attachment 200 by placing their foot on one of the flanges 244. The operator can then use a sweeping implement such as a broom B to move debris across the surface S into the suction zone 284. Debris within the suction zone 284 is drawn into the dustpan attachment 200 through the suction inlet 260. Debris is then transmitted along the fluid flow path FP, through the suction channel 280, the channel 276 of the vacuum port 264, the flexible hose 90, the vacuum cleaner inlet 22, and to the separator 26. Debris is then collected in the base 14 and clean air is exhausted through the clean air outlet 30. Once the surface S has been cleaned, the vacuum cleaner 10 can be powered off using the user control 54. The dustpan attachment 200 can be removed from the flexible hose 90. The flexible hose 90 can be removed from the vacuum cleaner inlet 22. Both the dustpan attachment 200 and the flexible hose 90 can be coupled to one of the accessory connectors 74. The debris collected in the base 14 can be emptied. The vacuum cleaner 10 can be moved and stored as needed.

FIGS. 7-12 illustrate another embodiment of an accessory tool 300. The accessory tool 300 is formed as a convertible dustpan attachment 300 for selective use with a vacuum cleaner, such as the vacuum cleaner 10. The convertible dustpan attachment 300 is similar to the dustpan attachment 200 and like features are identified using like numbers, plus '100.'

Figure 7:
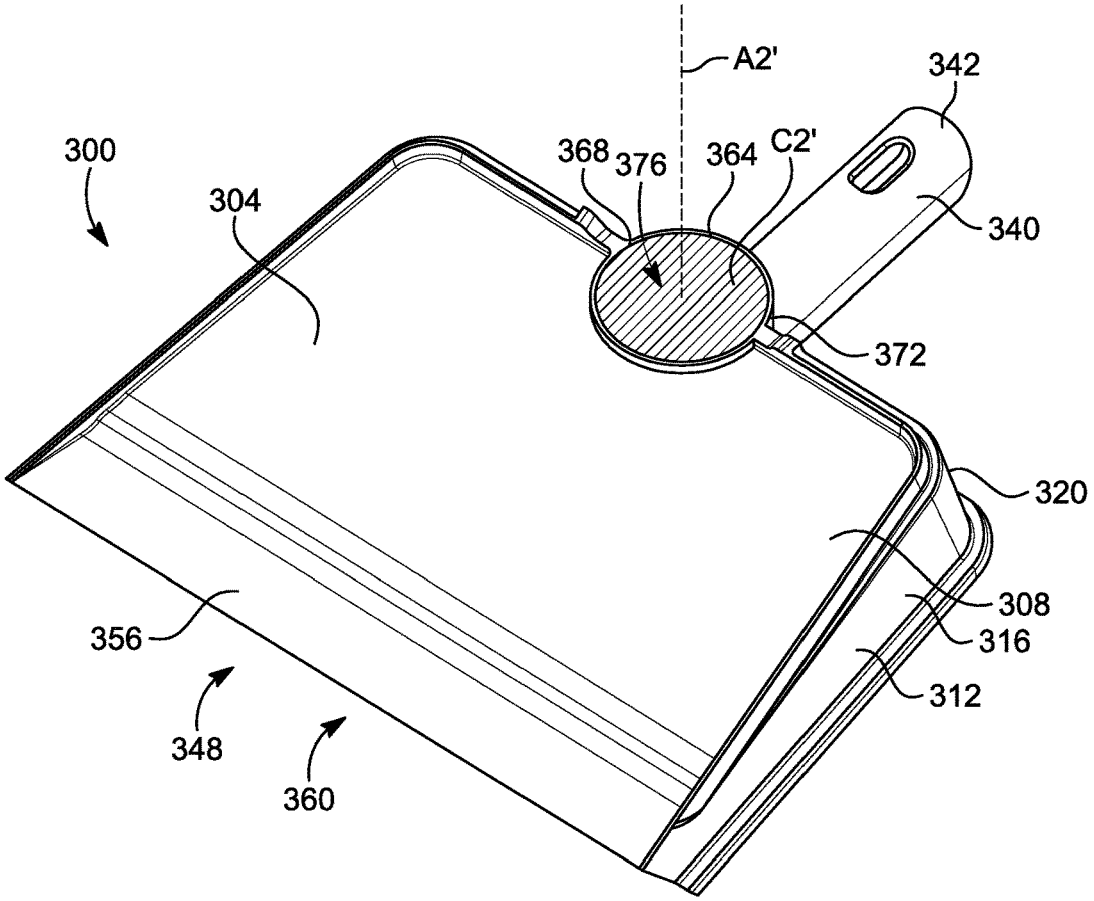
FIG. 7 is an upper perspective view of an accessory tool for use with a vacuum cleaner, for example the vacuum cleaner shown in FIG. 1.
Figure 8:
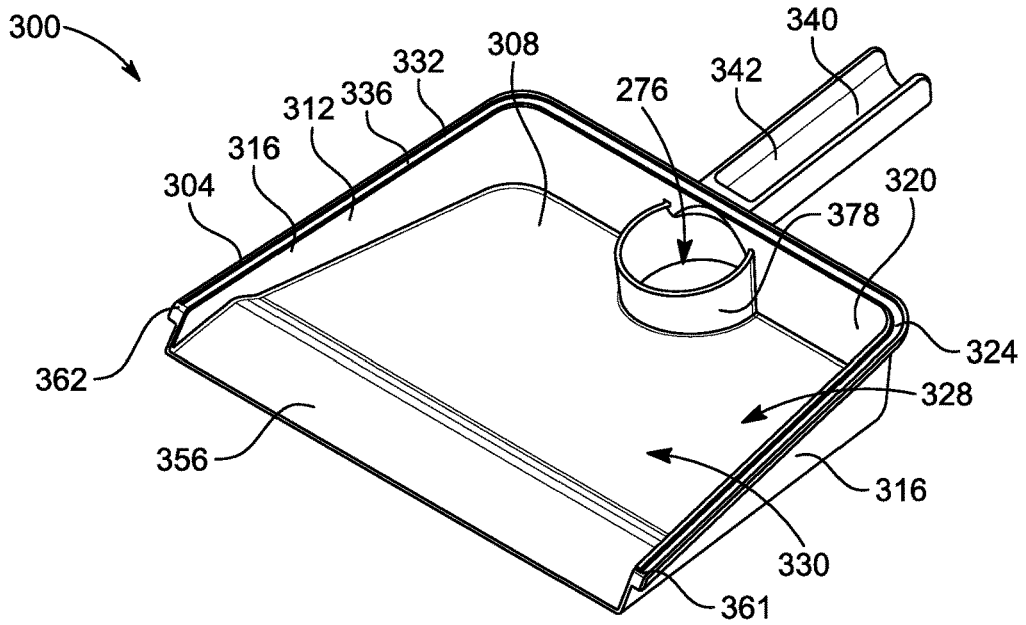
FIG. 8 is a lower perspective view of the accessory tool of FIG. 7.

As shown in FIGS. 7 and 8, the dustpan attachment 300 includes a housing 304 with a top wall 308 and a plurality of walls 312 extending from the top wall 308 to a bottom edge 324. The plurality of walls 312 includes a pair of side walls 316 and a rear wall 320. The top wall 308 and the plurality of walls 312 form a recess 328 in the housing 304. The bottom edge 324 includes a groove 332 for receiving a sealing element 336. The bottom edge 324 may be positioned against the surface S.

The housing 304 includes at least one receiving surface 340. In the illustrated embodiment, the receiving surface 340 is a handle 342 extending from the rear wall 320. The handle 342 may include an opening or other feature to allow the housing 304 to be hung from a hook or otherwise supported. When the bottom edge 324 is positioned against the surface S, the handle 342 contacts the surface S. The receiving surface 340 allows an operator to use their foot to secure the housing 304 relative to the surface S. The handle 342 can also be gripped by an operator and used to support the housing 304 above the surface S.

Figure 9:
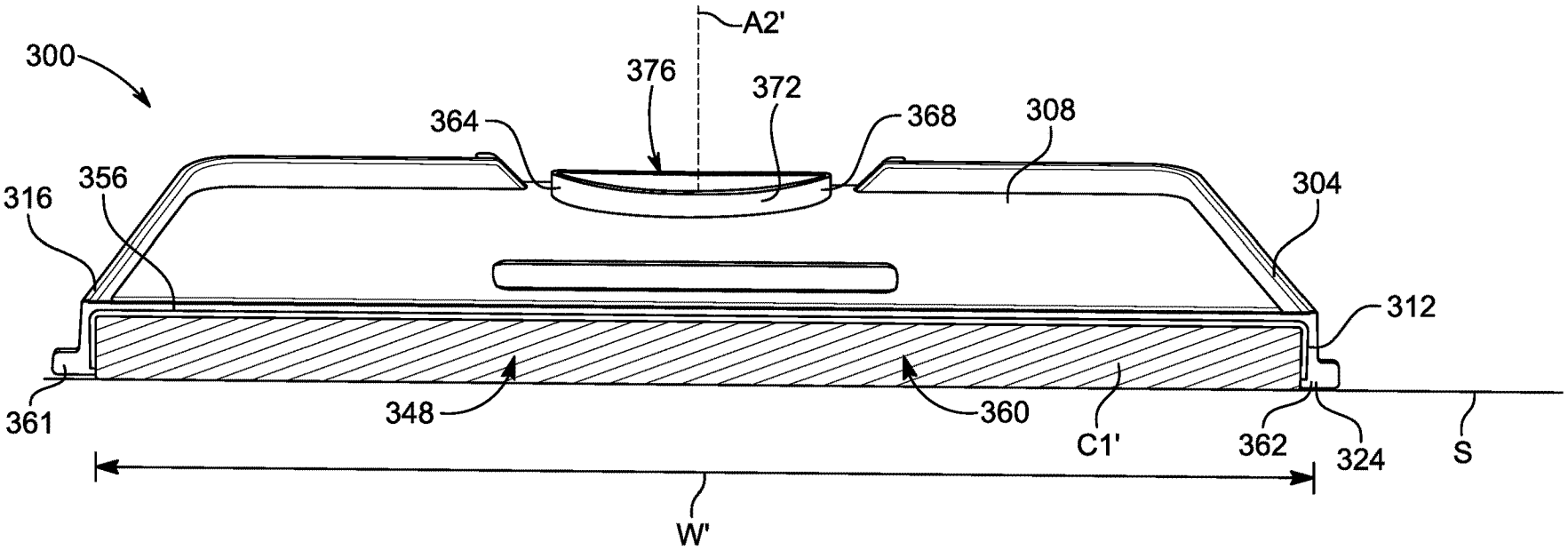
FIG. 9 is a front view of the accessory tool of FIG. 7.
Figure 10:
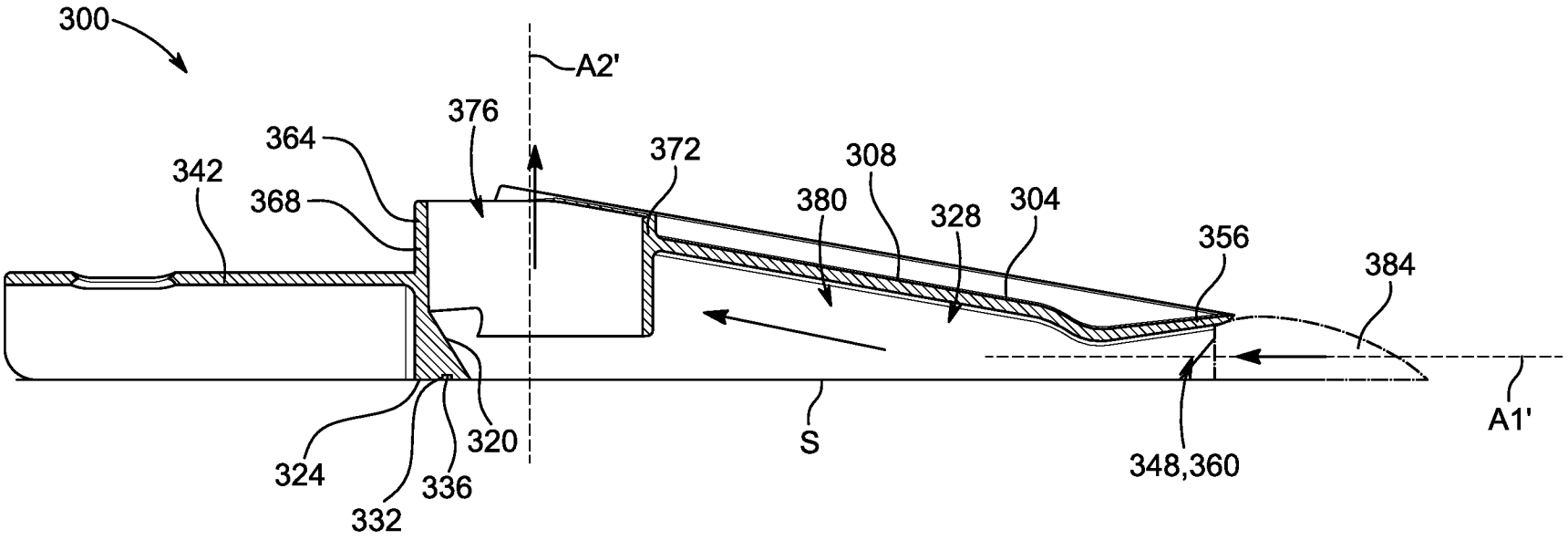
FIG. 10 is a cross sectional view of the accessory tool of FIG. 7 in a first position.

As shown in FIGS. 9 and 10, the housing 304 includes a front opening 348 formed below the front edge 356 of the top wall 308. The front opening 348 defines a suction inlet 360 when the bottom edge 324 is positioned against the surface S. The suction inlet 360 extends to a width W' which is equivalent to a full width of the housing 304. The width W' may be between 6 and 20 inches. The width W' may correspond to a width of a head of a sweeping device such as a broom B. The suction inlet 360 extends between a first end 361 of the housing 304, adjacent one end of the suction inlet 360, and a second end 362 of the housing 304, adjacent the opposite end of the suction inlet 360. The bottom edge 324 also extends between the first end 361 and the second end 362 around the recess 328. The bottom edge 324 includes resilient sealing material continuously between the first end 361 of the housing 304 and the second end 362 of the housing 304. The suction inlet 360 opens forwardly and extends into the housing 304 along a first axis A1'. When the bottom edge 324 is positioned against the surface S, the first axis A1' is generally horizontal. The suction inlet 360 has a cross sectional area C1' (or first area C1') measured perpendicular to the first axis A1'. The suction inlet 360 is generally rectangular in shape.

With reference back to FIG. 7, the housing 304 further includes a vacuum port 364. The vacuum port 364 includes a connector 368 formed by an outer wall 372 defining a channel 376 extending through the housing 304 and in communication with the recess 328. The vacuum port 364 further includes a retaining wall 378 extending down from the top wall 308 into the recess 328. The retaining wall 378 surrounds the channel 376. The vacuum port 364 extends along a second axis A2', which extend generally vertically when the bottom edge 324 is positioned against the surface S. The vacuum port 364 has a cross sectional area C2' (or second area C2') measured perpendicular to the second axis A2'. The cross sectional area C2' of the vacuum port 364 is equal in size to the cross sectional area C1' of the suction inlet 360.

Figure 12:
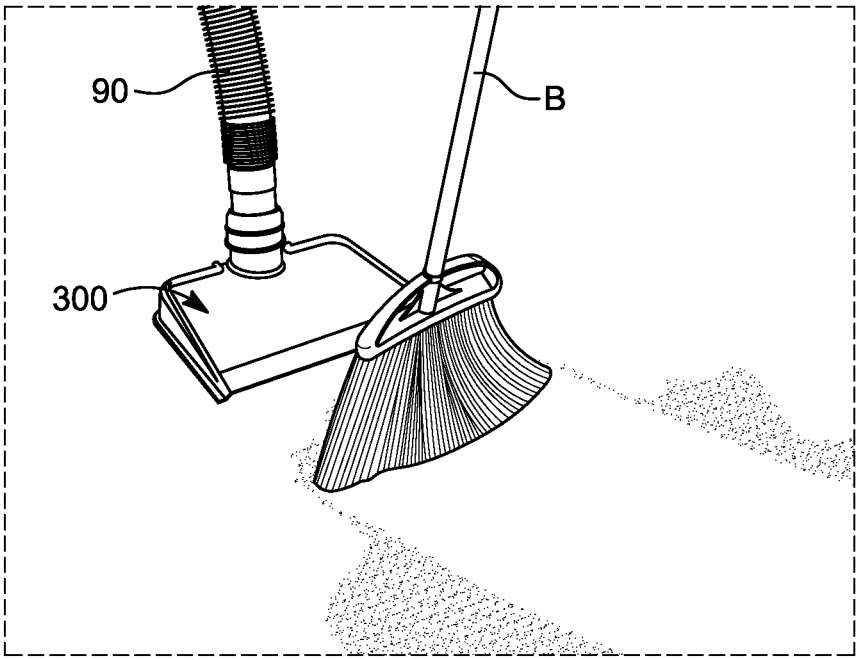
FIG. 12 illustrates the accessory tool of FIG. 7 in use with a vacuum cleaner.

As seen in FIGS. 10 and 12, when the bottom edge 324 is positioned against the surface S, the recess 328 cooperates with the surface S to define a suction channel 380 connecting the suction inlet 360 with the vacuum port 364.

As shown in FIG. 12, the convertible dustpan attachment 300 can be used in a first mode with the vacuum cleaner 10, substantially similar to the use of the dustpan attachment 200 discussed above. The flexible hose 90 is attached to the vacuum port 364 and the dustpan attachment 300 is positioned with the bottom edge 324 against the surface S. Debris from within a suction zone 384 is the drawn through the dustpan attachment 300, through the flexible hose 90, and to the vacuum cleaner 10. A sweeping implement such as a broom B can be used to move or sweep debris across the surface S so that debris enters the suction zone 384.

Figure 11:
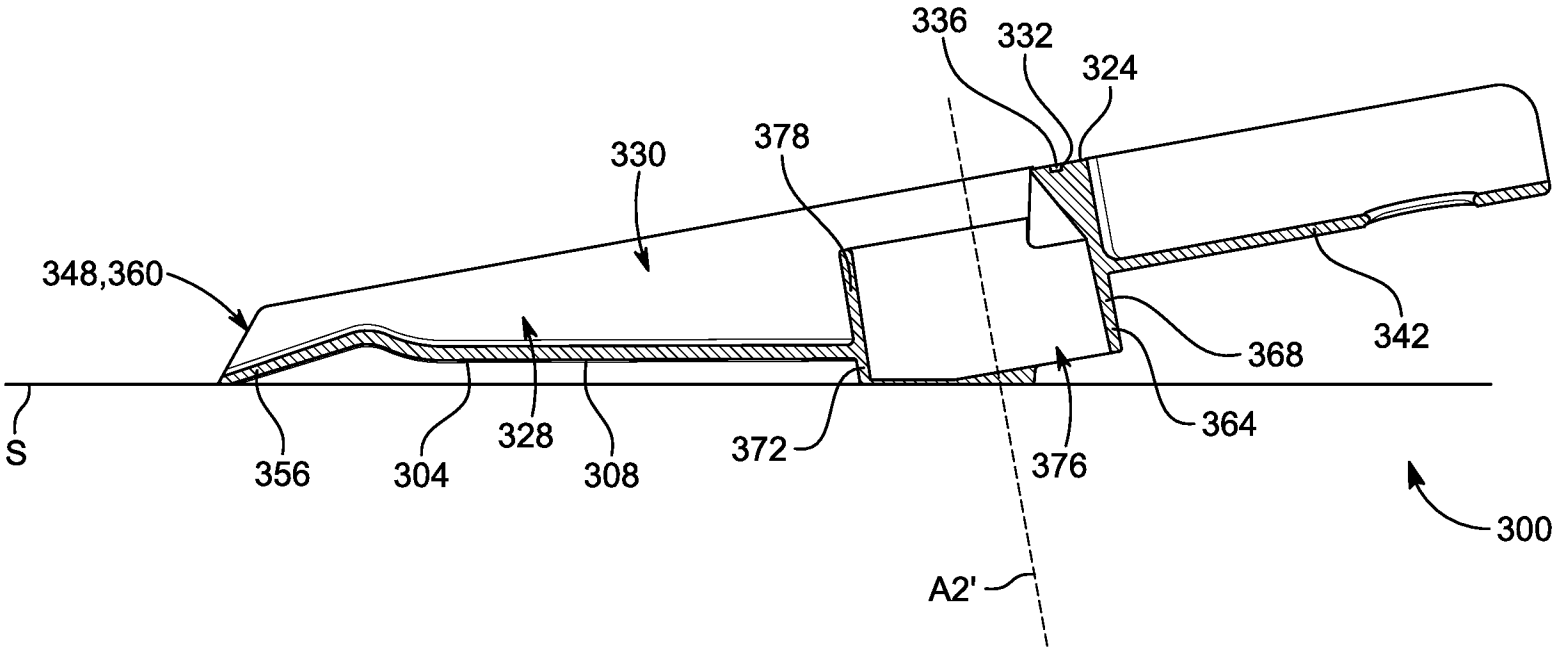
FIG. 11 is a cross sectional view of the accessory tool of FIG. 7 in a second position.

The convertible dustpan attachment 300 can also be used in a second mode, as seen in FIG. 11. In the second mode, the flexible hose 90 is removed from the vacuum port 364. Using the handle 342, an operator supports the housing 304 with the front edge 356 against the surface S and the top wall 308 below the recess 328. The recess 328 forms a collection volume 330. A sweeping implement such as the broom B shown in FIG. 11 can be used to move or sweep debris into the collection volume 330. In some embodiments the front edge 356 may be inclined with respect to the rest of the top wall 308, forming a ramp for guiding the debris into the collection volume 330. The retaining wall 378 prevents debris from exiting the collection volume 330 downwardly through the channel 376 of the vacuum port 364. Once the surface S has been cleaned, the dustpan attachment 300 can be carried by the handle 342 to a bin or another place to empty the collection volume 330. The dustpan attachment 300 can then be stored with the vacuum cleaner 10, with the broom B, or in another location.

Various features of the invention are set forth in the following claims.

What is claimed is:

1. A vacuum cleaner operable to be movable over a surface to be cleaned, the vacuum cleaner comprising:

a suction source;

a suction port in fluid communication with the suction source;

a dustpan attachment removably coupled to the suction port, the dustpan attachment including:

a housing including a top wall and a plurality of walls extending from the top wall to a bottom edge, the bottom edge configured to contact the surface, wherein the top wall includes a planar topside surface;

a vacuum port extending through at least the top wall or one of the plurality of walls, the vacuum port coupled to the suction port; and a recess defined within the housing, wherein when the bottom edge contacts the surface, the recess is configured to cooperate with the surface to form a suction channel having a suction inlet in communication with the vacuum port and formed in a front of the housing and opening forwardly, wherein the suction channel funnels from an outermost end of the suction inlet in the front of the housing to the vacuum port, wherein the housing defines a first end at one end of the suction inlet and second end at an opposite end of the suction inlet, and wherein the bottom edge includes a resilient sealing material that contacts the surface continuously between the first and second ends, wherein the plurality of walls includes a rear wall, a first sidewall, and a second sidewall opposite the first sidewall, wherein the first sidewall extends forward from the rear wall toward the suction inlet, wherein the second sidewall extends forward from the rear wall toward the suction inlet, wherein the bottom edge includes a bottom edge of the first sidewall, the rear wall, and the second sidewall, wherein the resilient sealing material extends continuously along the bottom edge of the first sidewall, the rear wall, and the second sidewall, and wherein the housing includes a planar receiving surface parallel to and non-coplanar with the planar topside surface of the top wall, the receiving surface configured to receive a foot of a user to prevent translation of the dustpan attachment relative to the surface.

2. The vacuum cleaner of claim 1, further comprising a debris collector in fluid communication with the vacuum port and the suction source, wherein debris is drawn through the suction inlet and transmitted to the debris collector.

3. The vacuum cleaner of claim 2, wherein the suction source creates a suction area adjacent the suction inlet, wherein when the debris enters the suction area, the debris is drawn through the suction inlet to the debris collector.

4. The vacuum cleaner of claim 3, wherein the debris can be swept into the suction area.

5. The vacuum cleaner of claim 1, wherein the suction inlet extends a full width of the housing.

6. The vacuum cleaner of claim 1, wherein the suction inlet extends along the front to a width between 6 and 20 inches.

7. The vacuum cleaner of claim 1, wherein the vacuum port extends through the top wall.

8. The vacuum cleaner of claim 1, wherein the receiving surface extends substantially parallel to the top wall at a location between the top wall and the surface when the bottom edge contacts the surface.

9. The vacuum cleaner of claim 8, wherein the receiving surface is a first receiving surface, wherein the dustpan attachment includes a second receiving surface opposite the first receiving surface such that the recess is positioned between the first receiving surface and the second receiving surface.

10. The vacuum cleaner of claim 1, wherein the receiving surface is a first receiving surface, wherein the dustpan attachment includes a second receiving surface opposite the first receiving surface such that the recess is positioned between the first receiving surface and the second receiving surface.

11. The vacuum cleaner of claim 1, wherein the receiving surface extends outward from a wall of the plurality of walls so as to extend away from the recess defined within the housing.

12. The vacuum cleaner of claim 1, wherein the receiving surface includes a raised lip extending about a periphery of the receiving surface.

13. A dustpan attachment for use with a vacuum cleaner configured to clean a surface, the vacuum cleaner having a suction port and a suction source for generating airflow through the suction port, the dustpan attachment comprising:

a housing including a top wall defining a first horizontal plane and a plurality of walls, the plurality of walls including a first side wall extending from the top wall to a bottom edge of the first side wall, a rear wall extending from the top wall to a bottom edge of the rear wall, and a second side wall extending from the top wall to a bottom edge of the second side wall, wherein the bottom edges of the first side wall, the rear wall, and the second side wall are configured to collectively contact the surface;

a vacuum port extending through at least the top wall or one of the plurality of walls, the vacuum port configured to removably couple to the suction port; and a recess defined within the housing, wherein when the bottom edges of the first side wall, the rear wall, and the second side wall collectively contact the surface, the recess is configured to cooperate with the surface to form a suction channel having a suction inlet in communication with the vacuum port and formed in a front of the housing and opening forwardly, wherein the housing defines a first end at one end of the suction inlet and second end at an opposite end of the suction inlet, and wherein the bottom edges of the first side wall, the rear wall, and the second side wall include a resilient sealing material that contacts the surface continuously between the first and second ends, wherein the suction channel is enclosed within the suction inlet, the first side wall, the second side wall, and the rear wall, and wherein the housing includes a receiving surface defining a second horizontal plane offset from the first horizontal plane and extending outward from a wall of one of the first side wall, the rear wall, or the second side wall so as to extend away from the recess defined within the housing, the receiving surface configured to receive a foot of a user to prevent translation of the dustpan attachment relative to the surface, wherein an exterior of the housing steps down from the first horizontal plane at the top wall to the second horizontal plane at the receiving surface via the wall of the plurality of walls.

14. The dustpan attachment of claim 13, wherein the suction inlet defines a first area and the vacuum port defines a second area, and wherein the first area and the second area are equal in size.

15. The dustpan attachment of claim 13, wherein the receiving surface includes a textured flange extending from the bottom edges of the first side wall, the rear wall, and the second side wall.

16. The dustpan attachment of claim 13, wherein the suction channel converges in a width direction from the suction inlet to the vacuum port.

17. The dustpan attachment of claim 13, wherein at least a portion of the rear wall is curved and contours a peripheral portion of the vacuum port.

18. A dustpan attachment for use with a vacuum cleaner configured to clean a surface, the vacuum cleaner having a suction port and a suction source for generating airflow through the suction port, the dustpan attachment comprising:

a housing including a top wall, a pair of sidewalls, and a rear wall extending from the top wall to a bottom edge, the bottom edge configured to contact the surface;

a vacuum port extending through the top wall, the vacuum port configured to removably couple to the suction port;

a recess defined by the top wall, the pair of sidewalls, and the rear wall, wherein when the bottom edge contacts the surface, the recess is configured to cooperate with the surface to form a suction channel in communication with the vacuum port, the suction channel enclosed between the pair of sidewalls, the rear wall, and a front of the housing, the front of the housing extending linearly along an overall width of the housing; and a suction inlet defined at the front of the housing and opening forwardly, the suction inlet in fluid communication with the vacuum port such that debris in an area in front of the suction inlet is drawn through the suction channel into the suction port, wherein the housing defines a first end at one end of the suction inlet and second end at an opposite end of the suction inlet, and wherein the bottom edge includes a resilient sealing material that contacts the surface continuously between the first and second ends, and wherein the suction inlet extends linearly along the front of the housing, wherein the housing includes a first receiving surface spaced apart from the top wall and a second receiving surface spaced apart from the top wall, the first and second receiving surfaces configured to receive a foot of a user to prevent translation of the dustpan attachment relative to the surface, wherein the first and second receiving surfaces are positioned on opposite sides of the housing.

19. The dustpan attachment of claim 18, wherein the first receiving surface extends parallel to the top wall.

20. The dustpan attachment of claim 19, wherein, when the bottom edge is configured to contact the surface, the first receiving surface extends parallel to the surface.

* * * * *